US011369987B2

(12) United States Patent
Zahlen et al.

(10) Patent No.: US 11,369,987 B2
(45) Date of Patent: Jun. 28, 2022

(54) DEVICE AND SYSTEM

(71) Applicant: Airbus Operations GmbH, Hamburg (DE)

(72) Inventors: Pierre C. Zahlen, Hamburg (DE); Alexander Gillessen, Hamburg (DE); Sebastian Kerger, Hamburg (DE)

(73) Assignee: Airbus Operations GmbH, Hamburg (DE)

( * ) Notice: Subject to any disclaimer, the term of this patent is extended or adjusted under 35 U.S.C. 154(b) by 98 days.

(21) Appl. No.: 16/829,925

(22) Filed: Mar. 25, 2020

(65) Prior Publication Data

US 2020/0306786 A1 Oct. 1, 2020

(30) Foreign Application Priority Data

Mar. 29, 2019 (DE) ..... 10 2019 108 210.2

(51) Int. Cl.
*B05C 1/08* (2006.01)
*B05C 21/00* (2006.01)
*B05C 11/10* (2006.01)

(52) U.S. Cl.
CPC ..... *B05C 1/0813* (2013.01); *B05C 1/0808* (2013.01); *B05C 1/0821* (2013.01); (Continued)

(58) Field of Classification Search
CPC ... B05C 1/0813; B05C 1/0808; B05C 1/0821; B05C 1/0886; B05C 21/00; B05C 9/12; (Continued)

(56) References Cited

U.S. PATENT DOCUMENTS 5,425,848 A 6/1995 Haisma et al.
6,174,567 B1 1/2001 Ueberschär et al.
(Continued)

FOREIGN PATENT DOCUMENTS

CN 102 463 293 A 5/2012
DE 10 84 469 B 6/1960
(Continued)

OTHER PUBLICATIONS

Non-Final Office Action for U.S. Appl. No. 16/844,132 dated May 13, 2021.
(Continued)

*Primary Examiner* — Laura Edwards
(74) *Attorney, Agent, or Firm* — Jenkins, Wilson, Taylor & Hunt, P.A.

(57) ABSTRACT

A device and a system for a lacquer transfer with a frame, transfer roller with a circumferential lateral wall, a drive unit, a slit nozzle, the slit nozzle at least indirectly connected to the frame, an outside contact surface of the lateral wall including depressions, the transfer roller mounted rotatably about an axis of rotation at the frame, the drive unit configured to drive the transfer roller for the transfer roller to rotate about the axis of rotation. The slit nozzle includes a supply connection, nozzle-cavity, slit-shaped nozzle-channel and at least one limiter, the supply connection coupled to the nozzle-cavity for supplying lacquer to the nozzle-cavity, the nozzle-channel extending from the nozzle-cavity to a muzzle end formed by the slit nozzle at the end of the nozzle-channel for dispensing lacquer, the slit nozzle configured by the limiter to adjust a cross-section in a restriction area of the nozzle-channel.

20 Claims, 8 Drawing Sheets

(52) U.S. Cl.
CPC ..... *B05C 1/0886* (2013.01); *B05C 11/1005* (2013.01); *B05C 21/00* (2013.01)

(58) Field of Classification Search
CPC ..... B05C 11/1005; B05C 1/02; B05C 5/0262; B05D 5/00; B05D 1/28
USPC ..... 118/304, 712
See application file for complete search history.

(56) References Cited

U.S. PATENT DOCUMENTS

| | | | | |
|---|---|---|---|---|
| 6,344,088 | B1 * | 2/2002 | Kamikihara | B05C 5/0254 118/712 |
| 6,554,900 | B1 | 4/2003 | Aydin et al. | |
| 6,627,262 | B1 | 9/2003 | Soas et al. | |
| 9,808,823 | B2 | 11/2017 | Pagendarm et al. | |
| 10,173,238 | B2 | 1/2019 | Sturm et al. | |
| 10,335,824 | B2 | 7/2019 | Mueller | |
| 2001/0032585 | A1 | 10/2001 | Koehn et al. | |
| 2002/0108635 | A1 | 8/2002 | Marrero | |
| 2005/0061655 | A1 | 3/2005 | Gros et al. | |
| 2006/0066703 | A1 | 3/2006 | Kadomatsu et al. | |
| 2010/0080958 | A1 | 4/2010 | Goelling | |
| 2010/0233354 | A1 | 9/2010 | Barral et al. | |
| 2012/0148727 | A1 | 6/2012 | Heo et al. | |
| 2012/0313274 | A1 | 12/2012 | Loukusa et al. | |
| 2013/0341497 | A1 | 12/2013 | Zuardy et al. | |
| 2014/0305583 | A1 | 10/2014 | Casset | |
| 2015/0064389 | A1 | 3/2015 | Zahlen et al. | |
| 2015/0251409 | A1 | 9/2015 | Ohnishi | |
| 2015/0273762 | A1 | 10/2015 | Okamoto | |
| 2017/0080454 | A1 | 3/2017 | Hidaka et al. | |
| 2017/0095831 | A1 | 4/2017 | Sturm et al. | |
| 2017/0266691 | A1 | 9/2017 | Travis | |
| 2018/0281297 | A1 | 10/2018 | Pringle et al. | |
| 2020/0306785 | A1 | 10/2020 | Zahlen et al. | |
| 2020/0306787 | A1 | 10/2020 | Zahlen et al. | |
| 2020/0306791 | A1 | 10/2020 | Zahlen et al. | |
| 2020/0324310 | A1 | 10/2020 | Zahlen et al. | |
| 2020/0324315 | A1 | 10/2020 | Zahlen et al. | |
| 2020/0353498 | A1 | 11/2020 | Kerger et al. | |

FOREIGN PATENT DOCUMENTS

| | | | | |
|---|---|---|---|---|
| DE | 34 19 867 | C1 | | 9/1985 |
| DE | 37 21 593 | A1 | | 1/1989 |
| DE | 694 05 451 | T2 | | 3/1998 |
| DE | 699 10 430 | T2 | | 3/2004 |
| DE | 699 24 956 | T2 | | 9/2005 |
| DE | 20 2006 003 265 | U1 | | 6/2006 |
| DE | 10 2014 104 340 | A1 | | 10/2015 |
| DE | 10 2014 015 622 | A1 | | 4/2016 |
| DE | 20 2016 101 299 | U1 | | 6/2017 |
| DE | 10 2016 224 592 | A1 | | 6/2018 |
| EP | 0 408 283 | A2 | | 1/1991 |
| EP | 1 034 905 | A2 | | 9/2000 |
| EP | 1 117 488 | B1 | | 5/2004 |
| EP | 2 021 180 | B1 | | 11/2011 |
| EP | 3 248 692 | A1 | | 11/2017 |
| EP | 3 263 447 | A1 | | 1/2018 |
| EP | 2 632 605 | B1 | | 5/2019 |
| EP | 3 722 007 | A1 | | 10/2020 |
| EP | 3 722 009 | A1 | | 10/2020 |
| EP | 3 725 422 | A1 | | 10/2020 |
| EP | 3 725 539 | A1 | | 10/2020 |
| EP | 3 733 300 | A1 | | 11/2020 |
| EP | 3 750 637 | A1 | | 12/2020 |
| GB | 1 555 771 | A | | 11/1979 |
| JP | 60250936 | A | * | 12/1985 |
| JP | S63274748 | A | | 11/1988 |
| JP | 2005-034740 | A | | 2/2005 |
| JP | 2006-026558 | A | | 2/2006 |
| JP | 2008-086882 | A | | 4/2008 |
| KR | 2001/0093377 | A | | 10/2001 |
| TW | 2011 03647 | A | | 2/2011 |
| WO | WO 89/11343 | A2 | | 11/1989 |
| WO | WO 99/60210 | A1 | | 11/1999 |
| WO | WO 02/026399 | A1 | | 4/2002 |
| WO | WO 2010/146998 | A1 | | 12/2010 |
| WO | WO 2015/064685 | A1 | | 5/2015 |
| WO | WO 2015/155128 | A1 | | 10/2015 |
| WO | WO 2018/150190 | A1 | | 8/2018 |

OTHER PUBLICATIONS

Non-Final Office Action for U.S. Appl. No. 16/829,898 dated Jun. 9, 2021.
European Search Report for Application No. 20166215.2 dated Sep. 7, 2020.
European Search Report for Application No. 20164300.4 dated Sep. 29, 2020.
German Search Report for Application No. 10 2019 108 292.7 dated Dec. 9, 2019.
German Search Report for Application No. 10 2019 108 280.3 dated Jan. 29, 2020.
German Search Report for Application No. 10 2019 108 210.2 dated Jan. 30, 2020.
German Search Report for Application No. 10 2019 108 186.6 dated Jan. 31, 2020.
German Search Report for Application No. 10 2019 109 580.8 dated Feb. 11, 2020.
German Search Report for Application No. 10 2019 109 790.8 dated Feb. 12, 2020.
European Search Report for Application No. 20164755.9 dated Sep. 15, 2020.
European Search Report for Application No. 20164573.6 dated Sep. 15, 2020,.
European Search Report for Application No. 20164756.7 dated Sep. 21, 2020.
European Search Report for Application No. 20168066.7 dated Sep. 22, 2020.
Restriction Requirement for U.S. Appl. No. 16/829,880 dated Oct. 1, 2021.
Notice of Allowance for U.S. Appl. No. 16/844,132 dated Oct. 4, 2021.
Corrected Notice of Allowance for U.S. Appl. No. 16/844,132 dated Oct. 15, 2021.
Final Office Action for U.S. Appl. No. 16/829,914 dated Nov. 9, 2021.
Notice of Allowance for U.S. Appl. No. 16/829,898 dated Nov. 19, 2021.
Non-Final Office Action for U.S. Appl. No. 16/829,914 dated Jul. 21, 2021.

* cited by examiner

DEVICE AND SYSTEM

CROSS-REFERENCE TO RELATED APPLICATION

This application claims priority to German Patent Application No. 10 2019 108 210.2 filed Mar. 29, 2019, the entire disclosure of which is incorporated by reference herein.

TECHNICAL FIELD

The disclosure herein relates to a device and a system for a lacquer transfer.

BACKGROUND

A device for a lacquer transfer is known from the publication WO 2015/155 128 A1. This publication discloses a device which is configured for transferring lacquer to a surface of a work piece. The work piece may be formed by a part of an aircraft, motor vehicle, boat or any other object. The work piece may therefore be referred to as an object. In an example, the work piece may be a part of an aircraft, for instance a wing of an aircraft. The surface of the work piece may be referred to as a substrate surface. The device may be referred to as an applicator. The device comprises a frame, a transfer roller with a circumferential lateral wall and a drive unit. An outside contact surface of the lateral wall comprises several depressions. Furthermore, the device has its own drive for a circumferential movement of the transfer roller. The transfer roller is mounted rotatably about an axis of rotation at the frame. The device can be connected to a robot arm and moved via the robot arm in parallel to the surface of the work piece, such that the transfer roller rolls with its contact surface on a surface of the work piece for transferring lacquer from the depressions in the lateral wall of the transfer roller to the surface of the work piece. Before the contact surface of the circumferential lateral wall of the transfer roller comes into contact with the surface of the work piece, the depressions of the lateral wall have to be filled with the lacquer, such that the lacquer can be transferred subsequently to the surface of the work piece while the transfer rollers rolls on this surface.

When transferring lacquer via the device to a surface of a substrate, an object is to transfer a desired or predetermined amount of a lacquer to the surface of the work piece. But the surface of the work piece may comprise areas, which should not be coated with lacquer. These areas are called non-application areas or lacquer-free areas. To protect the non-application areas during the transfer of the lacquer via the known device, these areas may be masked in advance via protective foils, sicker or similar protective layers, which can be removed after transferring the lacquer via the device. However, the previous installation of protective foils, sicker or similar protective layers and the subsequent removal results in a high effort, which should be avoided.

SUMMARY

An object of the disclosure herein is to provide a device and a system which is configured for transferring a controllable quantity of lacquer via a transfer roller to a surface of a work piece.

According to a first aspect of the disclosure herein, the object is solved by a device as described herein. In this context, the disclosure herein relates to a device for a lacquer transfer. The device comprises a frame, a transfer roller with a circumferential lateral wall, a drive unit and a slit nozzle. The slit nozzle is at least indirectly connected to the frame. An outside contact surface of the lateral wall comprises several depressions. The transfer roller is mounted rotatably about an axis of rotation at the frame, wherein the drive unit is configured to drive the transfer roller such that the transfer roller rotates about the axis of rotation. The slit nozzle comprises a supply connection, a nozzle-cavity, a slit-shaped nozzle-channel and at least one limiter. The supply connection is coupled to the nozzle-cavity for supplying lacquer to the nozzle-cavity, wherein nozzle-channel extends from the nozzle-cavity to a muzzle-end, which is formed by the slit nozzle at the end of the nozzle-channel and configured for dispensing lacquer. The slit nozzle is configured by the at least one limiter to adjust a cross-section in a restriction area of the nozzle-channel. The muzzle-end of the slit nozzle is arranged contactless or in direct contact with the outside contact surface for dispensing lacquer into respective depressions. The transfer roller is configured to roll with the outside contact surface on a work surface of a work piece for transferring the lacquer from the depressions to the work surface of the work piece.

Preferably, the device or at least its frame is configured to be releasably connected to a handling device, such as a robot with a robot arm. The frame may be configured to be releasably connected to the robot arm. Thus, the device may be a mobile device, in particular a mobile mechanical device.

The frame may form the basis of the device, since the slit nozzle is at least indirectly connected to the frame. For this purpose, the device may comprise further connector(s) for connecting the slit nozzle to the frame. Thus, the slit nozzle may be mounted and/or releasably connected to the frame.

The transfer roller is mounted rotatably at the frame. The transfer roller can therefore rotate about the axis of rotation. For this purpose, the device comprises the drive unit, which is configured to drive the transfer roller in a rotation direction of the transfer roller about the axis of rotation. The drive unit may also be at least indirectly connected or mounted to the frame. During use, the drive unit drives the transfer roller, such that the transfer roller rotates about the axis of rotation and rolls with the contact surface on a work surface. Furthermore, the device is moved translational in parallel to the work surface, preferably by a robot arm or another handling device, while the transfer roller rotates, such that the transfer roller rolls on the work surface for transferring lacquer.

The supply connection of the slit nozzle may be connected via a pipe or a tube to a lacquer supply unit, which may be configured to supply the lacquer via the tube or the pipe to the slit nozzle. The lacquer may be a self-hardening lacquer or a lacquer, which can be hardened via UV-light. The lacquer supplied to the slit nozzle may be a liquid medium or a viscous medium.

According to a first nozzle arrangement of the slit nozzle, the muzzle end of the slit nozzle may be arranged contactless to the outside contact surface of the lateral wall for dispensing lacquer into respective depressions.

According to a second nozzle arrangement of the slit nozzle, the muzzle end of the slit nozzle is arranged in direct contact with the outside contact surface of the lateral wall for dispensing lacquer into respective depressions.

If reference is subsequently made to the slit nozzle without explicitly specifying the first or second nozzle arrangement, the corresponding explanations may, in principle, apply as preferred embodiments to each of the two arrangements. Therefore, it may be possible to apply the respective explanations to one of the first and second nozzle arrangement or to both nozzle arrangements.

The slit nozzle is configured for dispensing lacquer into the depressions of the lateral wall of the transfer roller. The slit nozzle may also be configured for dispensing lacquer onto depression-free sections of the lateral wall of the transfer roller. Thus, the slit nozzle may be configured for dispensing a lacquer film onto the lateral wall of the transfer roller, wherein the lacquer of the lacquer film fills the depressions and the lacquer film extends in axial direction and partly in circumferential direction of the transfer roller. The lacquer film may therefore theoretically divide into a depression part, which fills the depressions, and a remaining part, which is also referred to as bulk or a bulk part. Therefore, the transfer roller may be configured to roll with the contact surface of the transfer roller on a work surface of a work piece for transferring the lacquer from the contact surface to the work surface of the work piece, such that the lacquer film is transferred to the work surface. This encompasses the transfer of the lacquer from the depressions, but also the transfer of the bulk part. If the transfer of the lacquer from the depressions to the work surface, in particular to a surface of a wing, is described in the following, this shall preferable not exclude the possible transfer of the bulk part to the respective surface and/or the possible transfer of the lacquer from the depressions via the lacquer film.

As explained in the introduction, a work piece may comprise areas, which should not be coated with lacquer. These areas are called non-application areas. Further, the work piece may comprise areas, where only a very limited amount of lacquer is to be transferred. It is therefore desirable, to adjust the amount of lacquer to be transferred to specific areas of the surface of the work piece. For this purpose, the slit nozzle comprises a supply connection, a nozzle-cavity, a slit-shaped-nozzle-channel and at least one limiter. The supply connection of the slit nozzle may be connected via a pipe or tube to a lacquer supply unit. Therefore, the lacquer may be pumped from the lacquer supply unit via the pipe or tube to the supply connection of the slit nozzle. The supply connection of the slit nozzle is coupled to the nozzle-cavity for supplying lacquer to the nozzle-cavity. The nozzle-cavity is therefore filled with lacquer. The nozzle-channel extends from the nozzle-cavity to a muzzle end. The muzzle end is formed at the end of the nozzle-channel by the slit nozzle. The muzzle end may therefore be formed at least partly by the nozzle-channel. The muzzle end is configured for dispensing lacquer provided by the nozzle-channel. As a result, lacquer supplied via the supply connection and the nozzle-cavity to the nozzle-channel flows through the nozzle-channel and is dispensed at the end of the nozzle-channel via the muzzle end. The slit nozzle is configured by at least one limiter for adjusting a cross-section in a restriction area of the nozzle-channel. The restriction area of the nozzle-channel may be arranged at a predefined position between the one end of the muzzle channel at the nozzle-cavity or the other end of the nozzle-channel at the muzzle end. The restriction area may be a limited area of the nozzle-channel. There is at least one limiter which can adjust the cross-section in the restriction area of the nozzle-channel, such that the cross-section is reduced. As a result, less lacquer can flow through the nozzle-channel, such that less lacquer is dispensed by the slit nozzle to the transfer roller. Therefore, the at least one limiter may be configured to limit and/or reduce the cross-section in the restriction area of the nozzle-channel. The at least one limiter may be formed by mechanical structure, which can be moved into the nozzle-channel, such that the cross-section is reduced by a part of the limiter extending into the nozzle-channel. The at least one limiter may be controllable. The at least one limiter may be connected to a control unit for controlling the position of the at least one limiter. The control unit may be a part of the device. The at least one limiter may therefore be controlled to adjust the cross-section in the restriction area of the nozzle-channel according to a reference signal, which represents a desired cross-section in the restriction area of the nozzle-channel. The control unit may comprise an input interface for receiving the reference signal.

As an effect, the cross-section in the restriction area of the nozzle-channel can be adjusted during use. For example, the cross-section may be limited or closed, such that a little or no lacquer flows through the nozzle-channel, respectively. This may be used, when the transfer roller comes close to a non-application area of the work piece. For instance, if the non-application area of the surface of the work piece should not be covered with lacquer, the at least one limiter is controlled to close the nozzle-channel at a time interval, when no lacquer is to be transferred to the transfer roller. Preferably, the time interval, when no lacquer is dispensed onto the outside contact surface of the transfer roller, is timed, such that the transfer roller does not transfer lacquer onto the non-application area of the surface of the work-piece. Consequently, the non-application area of the surface of the work piece does not need to be protected via foils, sticker or similar protective layers in advance. Instead, the transfer of the lacquer can be prevented for the respective non-application areas of the surface of the work piece with the at least one limiter of the slit nozzle. This reduces the effort for preparation required for the transfer of lacquer to the work piece and the subsequent post-processing effort. Moreover, the device allows to reduce the lacquer consumption. The device also enables to reduce the lead time and enables to improve the transition between areas, where lacquer is to be transferred and the non-application areas.

According to a preferred embodiment of the device, the at least one limiter or limiting device is configured to be displaced to reduce the cross-section in the restriction area of the nozzle-channel. The at least one limiter may therefore be displaced into the nozzle-channel resulting in the reduction of the cross-section of the nozzle-channel. The at least one limiter may also be displaced in the opposite direction, such that the cross-section of the nozzle-channel is enlarged (again). The at least one limiter may be configured to be displaced between a first position and a second position. In the first position, the at least one limiter may be arranged, such that the cross-section in the restriction area of the nozzle-channel represents a maximum cross-section. In a second position, the at least one limiter may be arranged, such that the cross-section of the nozzle-channel is less than the maximum cross-section. As an effect, the at least one limiter may be in the first position, if the transfer roller is not heading a non-application area. However, if the transfer roller is heading a non-application area, the at least one limiter may be displaced to be in the second position, such that the cross-section is limited or even closed.

According to a further preferred embodiment of the device, the at least one limiter is arranged at the muzzle end of the nozzle-channel. Therefore, the at least one limiter may be arranged at the front end of the nozzle-channel. This allows a precise adjustment of the flow rate of the lacquer through the nozzle-channel and therefore allows to precisely adjust the flow of lacquer to be dispensed by the muzzle end onto the outside contact surface of the transfer roller.

According to a further preferred embodiment of the device, the at least one limiter is arranged between the muzzle end and the nozzle-cavity. Lacquer flowing from the nozzle-cavity through the nozzle-channel to be dispensed by the muzzle end of the nozzle-channel can therefore be precisely adjusted with the at least one limiter arranged between the muzzle end and the nozzle-cavity. The at least one limiter is arranged to precisely adjust the cross-section in the restriction of the nozzle-channel, wherein this restriction area is also between the muzzle end and the nozzle-cavity.

According to a preferred embodiment of the device, the device comprises an actuator unit, which is at least indirectly connected to the at least one limiter and configured to displace the at least one limiter. As an effect, the actuator unit can actively displace the at least one limiter, such that the cross-section in the restriction area of the nozzle-channel is adjusted according to a predetermined or predefined value. For instance, the cross-section may be actively reduced or closed with the actuator unit by displacing the at least one limiting unit, such that the at least one limiting unit extends partly or fully into the nozzle-channel. The actuator unit may be a controllable actuator unit. For instance, the actuator unit may be an air driven, fluid driven or electrically driven actuator unit.

According to a preferred embodiment, the slit nozzle comprises at least two limiters. According to a further embodiment of the device, the slit nozzle comprises more than two limiters, preferably at least four limiters. Therefore, the slit nozzle may comprise several limiters. As a result, the flow of lacquer through the nozzle-channel can be limited in its cross-section differently with respect to the width. For instance, the cross-section on a left side of the nozzle-channel may be limited to a further extent than by another limiter of the right hand side of the nozzle-channel. Thus, the cross section of the nozzle-channel may be adjusted differently on different positions with respect to the width of the nozzle-channel. As an effect, the nozzle-channel may be limited with respect to its cross-section only in a sub-area of the restriction area of the nozzle-channel. As a result, lacquer may not flow through this sub-area of the nozzle-channel and therefore does not dispense in a respective area lacquer on the transfer roller. As an effect, the transfer roller may only be subject to a respective transfer of lacquer from the slit-nozzle to its contact surface such that a part of the transfer roller remains free from lacquer. This may be advantageous, if only the respective part of the transfer roller is heading a non-application area on the surface of the work piece.

According to a preferred embodiment of the device, the limiter is arranged in alignment one behind the other in the direction of a width of the nozzle-channel. The direction of the width is parallel to the axis of rotation of the transfer roller. Each of the limiters may be displaced to reduce a sub-cross-section of the whole cross-section in the restriction area of the nozzle-channel. As an effect, each of the respective sub-cross-sections may be individually adjusted by a displacement of the corresponding limiter. For instance, if the cross-section is supposed to be closed on the left side, the limiter arranged on the left side of the slit nozzle may be displaced to close the cross-section of the left hand side. For example, if the slit nozzle comprises seven limiters, the two limiters on the left side may be displaced to extend into the nozzle-channel, such that their associated sub-cross-sections are reduced closed. As an effect, the slit nozzle may not dispense lacquer on the left side and the transfer roller may not be able to transfer lacquer for a time period while the respective limiter is partly closing the nozzle-channel. This may be of advantage, if the transfer roller is heading a non-application area with its left side. In this case, the transfer roller may be free of a lacquer film on the left side of the transfer roller, such that this lacquer-film-free transfer roller is rolling over the non-application area. Thereafter, the limiter may be displaced in order to enlarge the cross-section of the nozzle-channel to its full amount.

According to a preferred embodiment of the device, the actuator unit of the device comprises for each limiter an associated actuator, which is configured to individually displace the associated limiter. As an effect, each of the limiters may be individually displaced by controlling the respective actuator of the actuator unit. In context with the example explained before, the actuators associated to the two limiters on the left side may be controlled, such that the two limiters on the left side are displaced to close the respective sub-sections of the nozzle-channel. However, this embodiment is not limiting the general concept of the disclosure herein. For instance, another of the limiters may be achieved. For all limiters may be displaced in parallel. The limiters may be displaced, such that each of the limits extends the same distance into the nozzle-channel. As a result, the flow of lacquer may be reduced to a predefined flow rate. But this has an effect for the whole slit nozzle resulting in a uniform distribution. But generally, each of the actuators may be controlled individually. Therefore, the displacement of each of the limits may be controlled individually.

According to a preferred embodiment of the device, the limiters are formed by rods, flaps, lever arms, membranes, inflatable bellows or inflatable tubes. In particular rods or flaps have been found to be of advantage. For instance, each limiter may be formed by a rod. The rods may be arranged one behind the other in direction of the width of the nozzle-channel. The rods may be arranged, such that no gap is between the rods. As a result, the rods may be displaced to extend partly or fully into the nozzle-channel, such that any particular cross-section may be formed by the displacement of the rods. In particular, the cross-section may be fully or partly closed. If the cross-section is only partly closed, this may refer to a sub-section on the left or right side or even in the middle of the nozzle channel. But if the rods are displaced uniformly, only the lower-sub-section of the nozzle-channel may be remained open. Similar effects can be achieved if the limiters are each formed by flaps, lever arms, membranes, inflatable bellows or inflatable tubes.

According to a preferred embodiment of the device, the slit nozzle comprises exact one limiter formed by a nozzle-part of the slit nozzle, wherein the nozzle-channel is at least partly formed by the nozzle-part. For instance, the slit nozzle may comprise at the nozzle channel a lower nozzle-part, which can be displaced towards the nozzle-channel such that the cross-section of the nozzle-channel is reduced. The slit nozzle may therefore comprise an upper part and a lower part which form the nozzle-channel, wherein the lower part may be displaced towards the upper part, in order to reduce the cross-section of the nozzle-channel. The nozzle-channel may be closed, if the lower part is displaced fully towards the upper part.

According to a second aspect of the disclosure herein, the object is solved by a device with features described herein. Therefore, the disclosure herein also relates to a system for a lacquer transfer. The system comprises a device according to the first aspect of the disclosure herein or according to one of the preferred embodiments of the device described above. The system also comprises a sensor, which is configured to detect a thickness of the lacquer. The system also comprises a control unit. The sensor of the system is connected to the control unit to transmit a sensor signal to the control unit, which sensor signal represents the detected thickness of the lacquer. The control unit is connected to the actuator unit of the device, such that the actuator unit is controllable via the control unit. The control unit is configured to control the actuator unit of the device based on the detected thickness of the lacquer. Since the system can detect the thickness of the lacquer via the sensor and control the control unit of the device via the control unit, the system may be configured to implement a closed loop control for controlling the thickness of the lacquer. As an effect, a precise thickness of the lacquer can be transferred to the surface of the work piece.

According to a preferred embodiment of the system, the sensor of the system is arranged to detect the thickness of the lacquer on the outside contact surface of the lateral wall of the transfer roller. For instance, the detector may be arranged to detect the thickness of the lacquer just behind the slit nozzle, such that the thickness of the lacquer can be detected even before it is transferred to the surface of the work piece.

According to a further embodiment of the system, the sensor of the system is arranged to detect the thickness of the lacquer transferred to the work surface of the work piece. For instance, if the frame of the device is moved in a transfer direction while the transfer roller rolls on the surface of the work piece, the sensor may be mounted to the frame at a position behind the transfer roller, such that the sensor can detect the thickness of the lacquer transferred to the surface of the work piece. This allows to precisely control the thickness of the lacquer transfer to the surface of the work piece.

According to a further preferred embodiment of the system, the control unit is configured to control each actuator of the actuator unit individually. For instance, if the transfer roller of the device is heading a non-application area of the surface of the work piece, it may be sufficient to prevent that a part in width-direction of the transfer roller is not transferring lacquer via the transfer roller while it rolls above the non-application area on the surface of the work piece. To achieve that the part in width-direction of the transfer roller is not dispensed with lacquer via the device, the control unit may control the actuators of the actuator unit, such that only those actuators displace the associated limiter, such that these limiters close their respective sub-cross-sections. The control unit may control the actuators again after the transfer roller is about to pass or already passed the non-application area on the surface of the work piece. As a result, the non-application areas of the surface of the work piece do not have to be covered for preventing lacquer to be transferred to the non-application areas.

Further features, advantages and application possibilities of the disclosure herein may be derived from the following description of exemplary embodiments and/or the figures. Thereby, all described and/or visually depicted features for themselves and/or in any combination may form an advantageous subject matter and/or features of the disclosure herein independent of their combination in the individual claims or their dependencies. Furthermore, in the figures, same reference signs may indicate same or similar objects.

DETAILED DESCRIPTION

Figure 1:
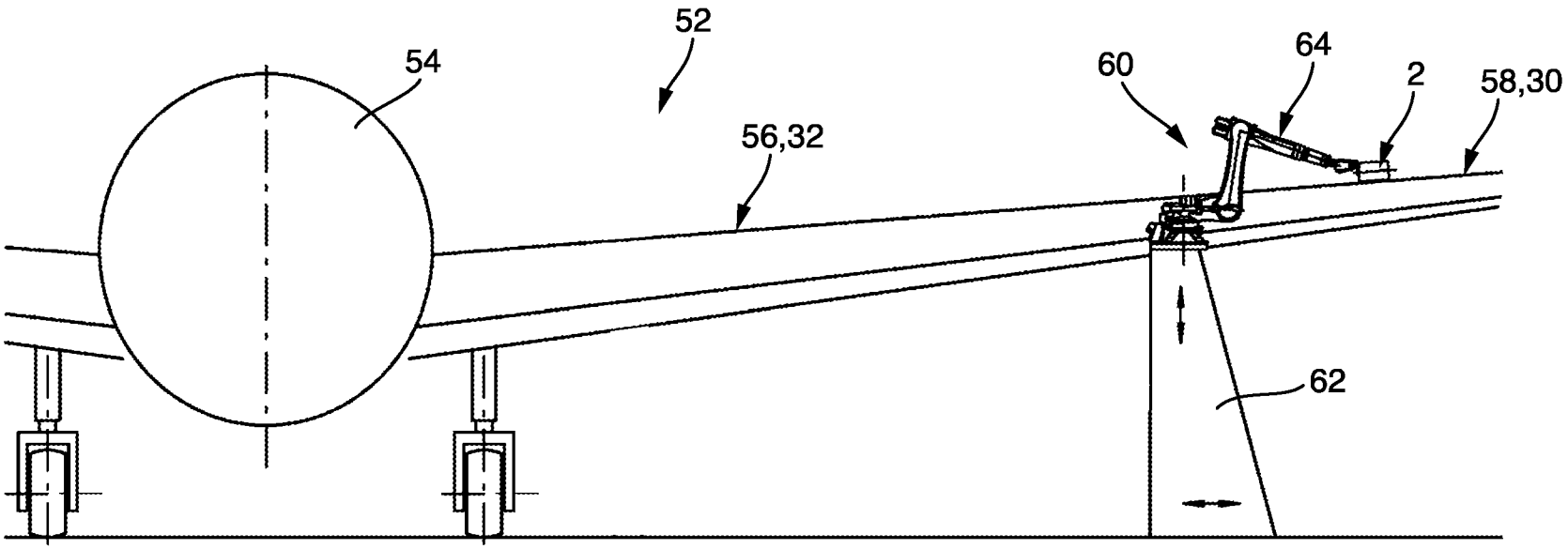
FIG. 1 schematically illustrates a part of an aircraft wherein a device is arranged for transferring lacquer on an upper wing surface.

FIG. 1 schematically illustrates an aircraft 52, which comprises a fuselage 54 and a wing 56. The air resistance of the aircraft 52 can be reduced, if the upper wing surface 58 of the wing 56 comprises a profile structure. It has been found of advantage, if this profile structure is a microstructure.

FIG. 1 also schematically shows a robot 60, which is seated on a rack 62. The robot 60 comprises a movable robot arm 64. A device 2 is mounted at an end of the robot arm 64, such that the device 2 can be moved by the robot 60.

The device 2 is configured for transferring a lacquer onto a work surface 30 of a work piece 32. According to the example shown in FIG. 1, the work piece 32 can be formed by the wing 56 of the aircraft 52. Thus, the upper wing surface 58 can form the work surface 30.

Figure 2:
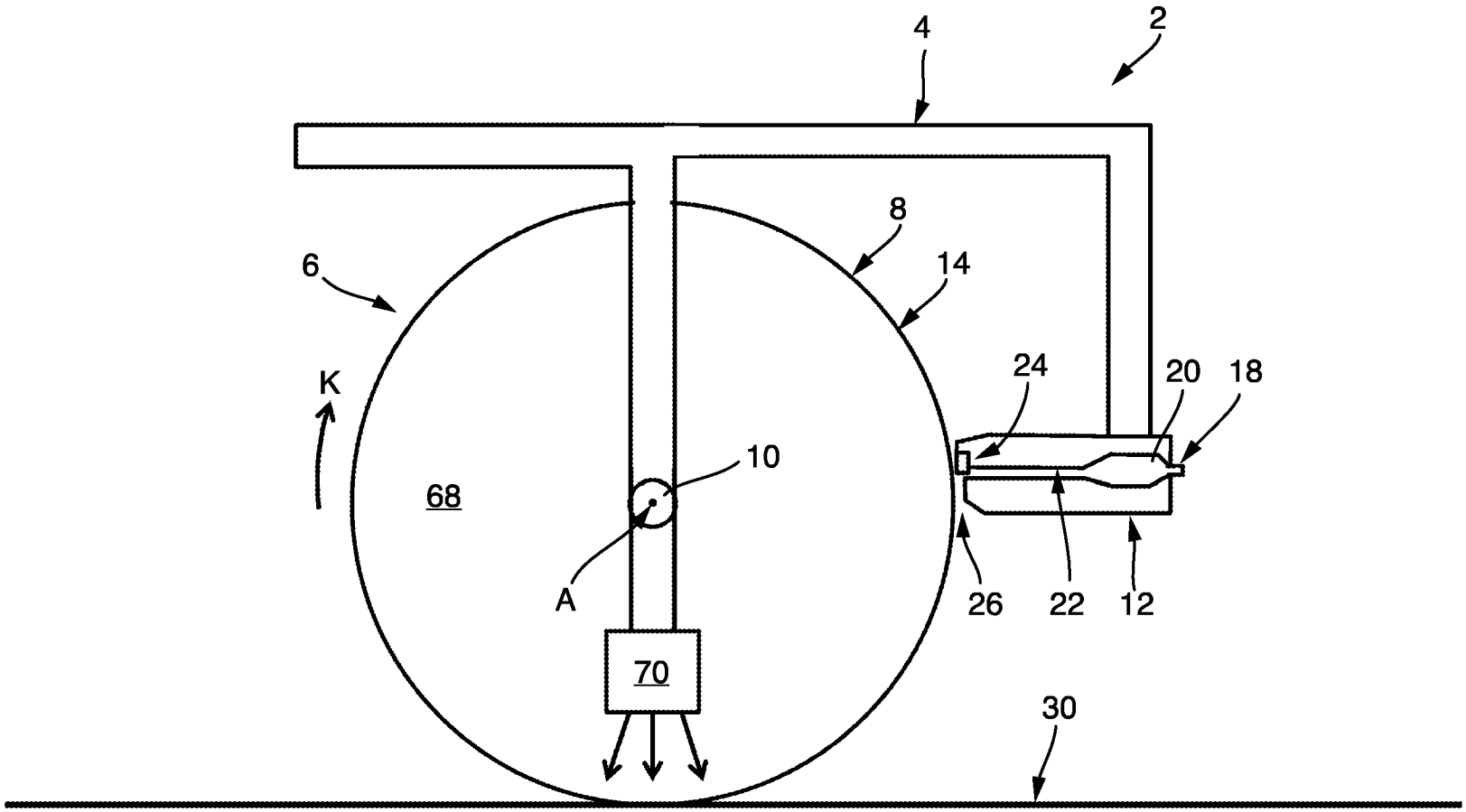
FIG. 2 schematically illustrates an embodiment of the device in a cross-sectional view.

A first embodiment of the device 2 is schematically illustrated in FIG. 2 in a cross-sectional view. The device 2 comprises a frame 4, a transfer roller 6 with a circumferential lateral wall 8, a drive unit 10 and a slit nozzle 12. The transfer roller 6 may also be referred to as a transfer tire. The device 2 can be attached via the frame 4 to the robot arm 64. However, instead of a robot 60 any other handling device may also be used, which is configured to move the device 2 in space. The frame 4 may be adapted to be releasably connected to a handling device, such as the robot 60.

The transfer roller 6 is mounted rotatably, in particular by at least one bearing, about an axis of rotation A at the frame 4. An outside contact surface 14 of the lateral wall 8 comprises several depressions 16. The depressions 16 may be evenly or stochastically distributed about the circumference of the lateral wall 8. The FIGS. 3 and 4 show a part of the transfer roller 6 in a cross-section view and a top view, respectively.

Figure 3:
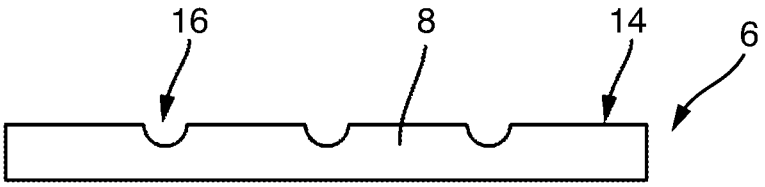
FIG. 3 schematically illustrates a part of the lateral wall of the transfer roller in a cross-sectional view.

As schematically indicated in FIG. 3, the depressions 16 can be formed by recesses arranged at the outside contact surface 14 of the lateral wall 8 of the transfer roller 6. The depressions 16 may have a predefined size and/or structure. A mean structure size of the depressions 16 can be in the range of 0.1 micrometer to 100 micrometer. In other words, each of the depressions 16 may have a microstructure.

Figure 4:
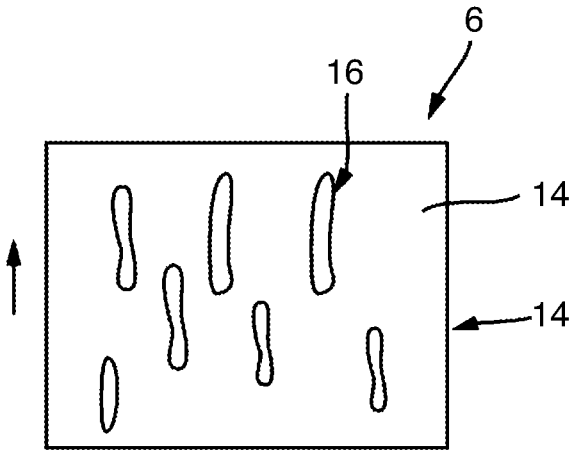
FIG. 4 schematically illustrates the part of the lateral wall of the transfer roller in a top view.

FIG. 4 exemplarily shows the depressions 16 of a part of the lateral wall 8 of the transfer roller 6 in a top view. Each of the depressions 16 may comprise an elongated extension in a circumferential direction U of the lateral wall 8 of the transfer roller 6.

Each of the depressions 16 is configured to receive lacquer and to transfer this received lacquer to a work surface 30 of a work piece 32, such as the upper wing surface 58 of a wing 56. Therefore, the several depressions 16 at the outside contact surface 14 of the lateral wall 8 may be arranged and/or formed according to a predefined structure, in particular a predefined microstructure. The lateral wall 8 is preferably made of silicone, such that a damage of the wing surface 58 can be prevented.

According to a preferred embodiment exemplarily illustrated in FIG. 2, the muzzle end 26 of the slit nozzle 12 is arranged close to but contactless with the outside contact surface 14 of the lateral wall 8 for dispensing lacquer from the muzzle end 26 into respective depressions 16. However, the muzzle end 26 of the slit nozzle 12 may be alternatively arranged in direct contact with the outside contact surface 14 of the lateral wall 8 for dispensing lacquer into the depressions 16. The depressions 16 of the lateral wall 8 arranged are therefore filled with lacquer.

The transfer roller 6 is driven by the drive unit 10, such that the transfer roller 6 rotates about the axis of rotation A. As a result, the lacquer is transported via the depressions 16 in rotation direction K such that the outside contact surface 14 with the depressions 16 filled with lacquer rolls in direct contact about the work surface 30 of the work piece 32 for transferring the lacquer to the work surface 30. In view of the example explained in connection with FIG. 1, the lacquer may be transferred to the wing surface 58 of the wing 56 of the aircraft 52.

If the depressions 16 are filled with a lacquer and if the outside contact surface 14 comes into contact with the work surface 30, in particular the wing surface 58, the lacquer previously received in the depressions 16 is transferred to the work surface 30, in particular the wing surface 58 of the aircraft 52. This transferred lacquer has a structure, in particular microstructure, corresponding to a structure defined by depressions 16. Thus, the outside contact surface 14 with its depressions 16 is configured for embossing a lacquer-structure, in particular a lacquer-microstructure, on the work surface 30, in particular the wing surface 58.

Figure 8:
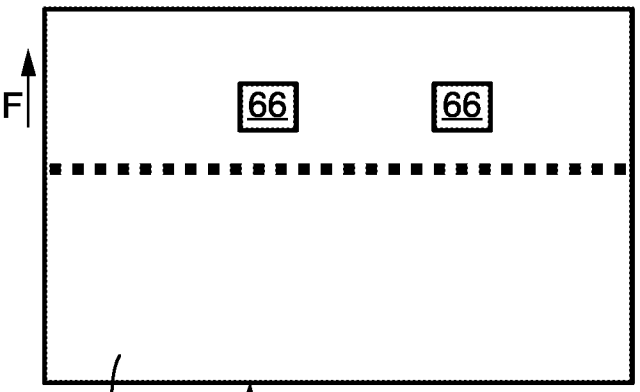
FIG. 8 schematically illustrates the part of the work piece in a top view.
Figure 6:
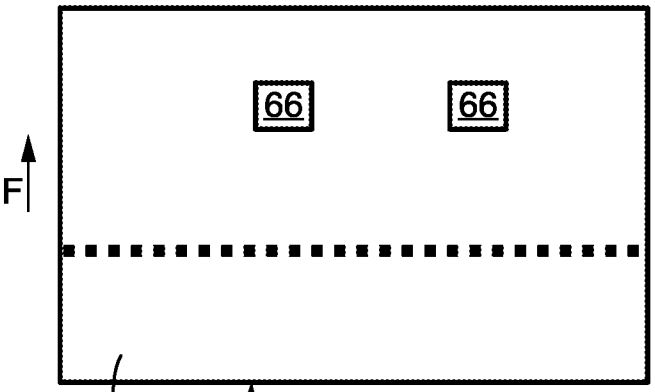
FIG. 6 schematically illustrates the part of the work piece in a top view.

Generally, it has been found of advantage, if microstructure lacquer is applied to the wing surface 58 of an aircraft wing 56. However, the aircraft wing 56 may comprise areas at the wing surface 58, which are not to be painted with lacquer. These areas are referred to as non-application areas 66 and schematically indicated in FIGS. 6 and 8. Both FIGS. 6 and 8 show a part of the wing surface 58 of the aircraft wing 56. The non-application areas 66 may form a section of the wing surface 58 of the aircraft wing 56, however, the non-application areas 66 are supposed to be free of a lacquer coating. In order to prevent a separate masking of this non-application area 66 with tape or stickers, it has been found of advantage, if the device 2 is configured to interrupt the transfer of lacquer to the wing surface 58 in the non-application areas 66 while the transfer roller rolls above the aircraft wing 56.

In order to allow the interruption of the transfer of lacquer to aircraft wing surface 58 of the aircraft wing 56, the slit nozzle 12 of the device 2 comprises a nozzle-cavity 20, a slit-shaped nozzle-channel 22 and at least one limiter 24. The nozzle-channel 22 extends from the nozzle-cavity 20 to a muzzle end 26, which is formed by the slit nozzle 12 at the end of the nozzle-channel 22 and configured for dispensing lacquer. In order to supply the nozzle-cavity 20 with lacquer, the slit nozzle 12 also comprises a supply connection 18. The supply connection 18 may be connected via a pipe or tube to a lacquer supply unit (which is not shown). Therefore, the lacquer supply unit can pump lacquer into the nozzle-cavity 20, such that the lacquer flows through the nozzle-channel 22 resulting in the dispensing of the lacquer at the muzzle end 26, such that the lacquer is applied to the outside contact surface 14 of the lateral wall 8 of the transfer roller 6.

The amount of lacquer dispensed via the slit nozzle 12 into the outside contact surface 14 depends on the size of the cross-section 28 of the nozzle-channel 22. In particular, the amount of lacquer may depend on the smallest cross-section 28 of the nozzle-channel 22. Therefore, in the following reference is made to the cross-section 28 in a restriction area of the nozzle-channel 22. The cross-section 28 in the restriction area of the nozzle-channel 22 preferably refers to the smallest cross-section 28 of the nozzle-channel 22. By reducing or enlarging the size of the cross-section 28 in the restriction area of the nozzle-channel 22, the amount of lacquer dispensed by the slit nozzle 12 onto the outside contact surface 14 may be controlled. The slit nozzle 12 is therefore configured by at least one limiting mean 24 to adjust the cross-section 28 in a restriction area of the nozzle-channel 22. In this context, reference is made to FIG. 5, which shows an embodiment of a cross-section 28 in view of the slit nozzle 12.

Figure 5:
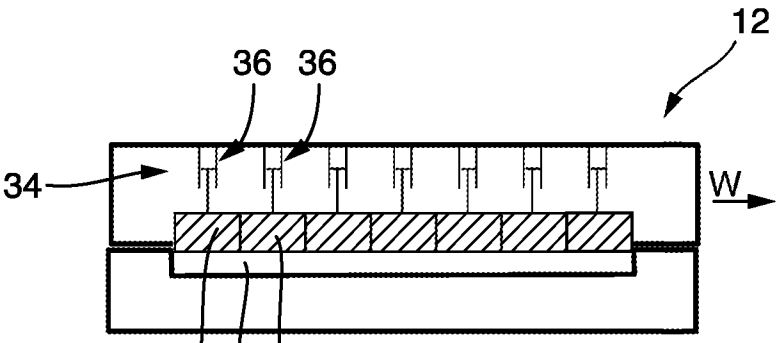
FIG. 5 schematically illustrates an embodiment of the slit nozzle in a cross-sectional view, wherein the limiter is in a first position.

The limiter 24 of the slit nozzle 12 may be configured to be displaced in a direction perpendicular to the width and/or the flow direction of lacquer through the nozzle-channel 22. As a result, the cross-section 28 of the nozzle-channel 22 can be adjusted by a displacement of the limiter 24. Preferably, the slit nozzle 12 comprises a plurality of limiters 24, which are arranged in alignment one behind the other in the direction W of the width of the nozzle-channel 22. The direction W of width of the nozzle-channel 22 is parallel to the axis of rotation A. Moreover, the slit nozzle 12 preferably comprises an actuator unit 34 which comprises several actuators 36. As indicated in FIG. 5, the actuator unit 34 preferably comprises for each limiter 24 an associated actuator 36, which is configured to individually displace the associated limiter 24. The actuator unit 34, in particular its actuators 36 may be controlled, such that the limiter 24 is displaced in parallel to enlarge or reduce the size of the cross-section 28 of the nozzle-channel 22. Therefore, even if the flow rate through the nozzle-channel 22 may be increased or reduced, the distribution with respect to the width W may remain uniform.

Figure 7:
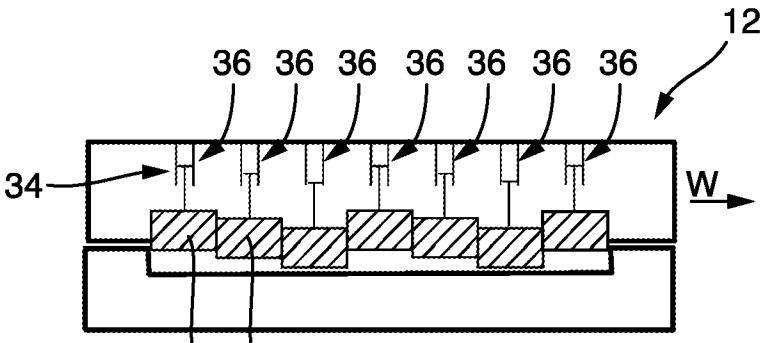
FIG. 7 schematically illustrates the slit nozzle of FIG. 5 in a cross-sectional view, wherein the limiter is in another position.

In practice however, non-application areas 66 are often arranged, such that only subsections of the transfer roller 6 with respect to its width are to be interrupted in its transfer of lacquer. It has therefore been found of advantage, that the limiter 24 may be displaced individually, as it is indicated in FIG. 7. The position of the transfer roller 6 in contact with the wing surface 58 of the aircraft wing 56 is indicated with the dashed line in FIGS. 6 and 8. If the device 2 is moved into the driving direction F, the transfer roller 6 may reach a position in front of at least one non-application area 66. If such a position is reached, the actuator unit 34 may be controlled, for example, such that the third and the sixth actuator 36 are displaced, such that the associated limiter 24 fully closes a corresponding sub-section of the nozzle-channel 22. This is indicated in FIG. 7. As a result, a strip on the outside contact surface 14 is not dispensed with lacquer via the slit nozzle 12. This lacquer-free-strip on the outside contact surface 14 will roll over the non-application area 66 of the aircraft surface, while the transfer roller 6 is rotated about the axis of rotation A. Since the lacquer-free-strip does not transfer lacquer on the non-application area 66, this non-application area 66 does not have to be masked in advance or even being clean afterwards. The effort is therefore significantly reduced. Even though the displacement of the limiter 24 has been described in a context of the above example, the actuator unit 34 in particular in connection with its actuator 36, may be configured to displace each of the limiter 24 according to reference signal.

Figure 11:
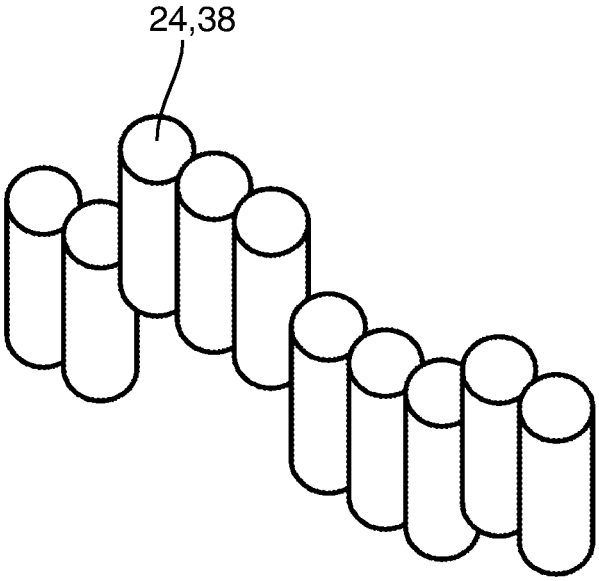
FIG. 11 schematically illustrates an embodiment of the limiter as rods.
Figure 12:
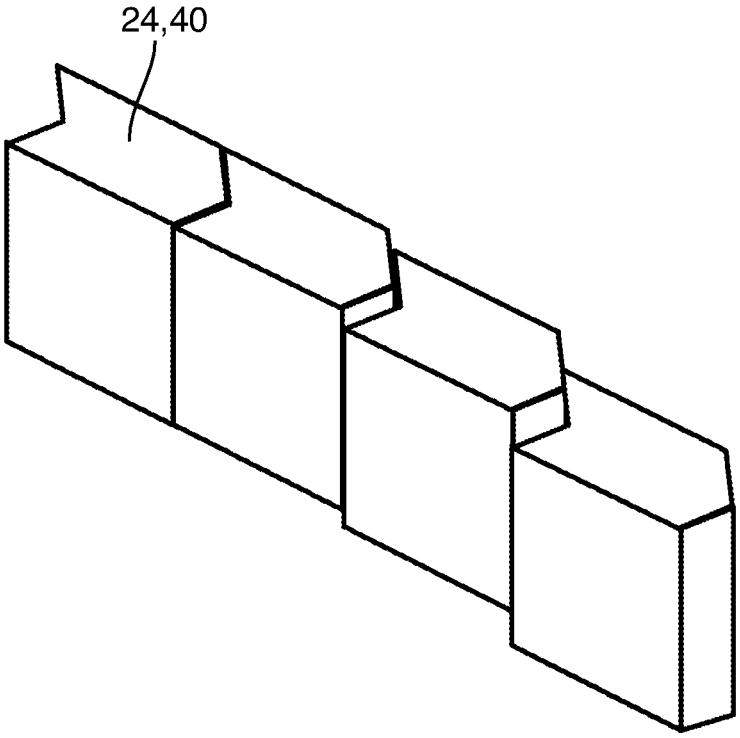
FIG. 12 schematically illustrates another embodiment of the limiter as flaps.

Examples of possible embodiments of the limiter 24 are schematically shown in FIGS. 11 and 12. The limiters 24 indicated in FIG. 11 are formed by rods 38. The limiters 24 indicated in FIG. 22 are formed by flaps 40.

Figure 13:
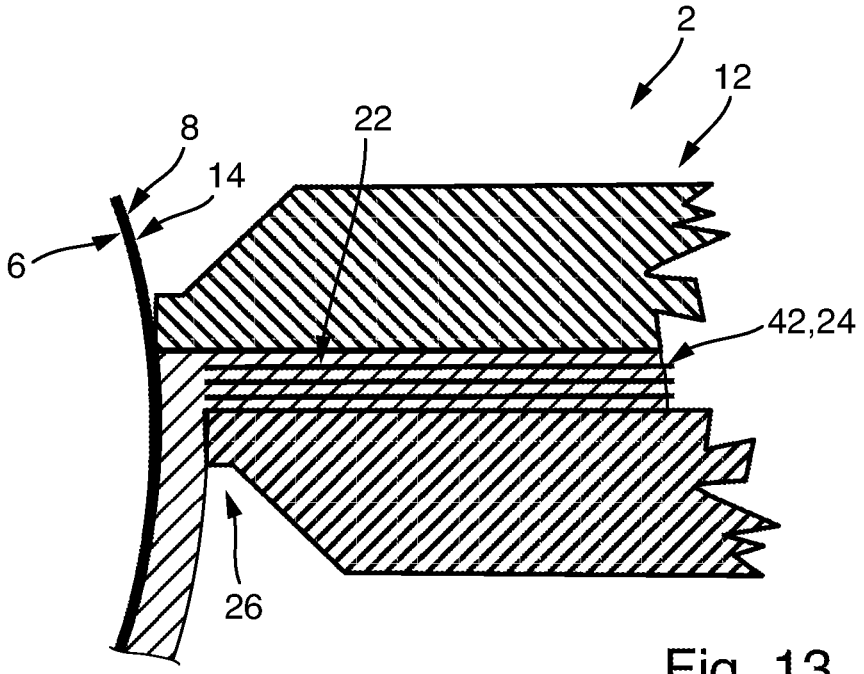
FIG. 13 schematically illustrates a part of the slit nozzle with another embodiment of the limiter as inflatable tubes.

Another embodiment of the limiter 24 is schematically shown in FIG. 13, which shows a part of the device 2 and its slit nozzle 12. The limiter 24 may be formed by inflatable tubes 42. These tubes 42 may be inflated in order to adjust the size of the cross-section 28 of the nozzle-channel 22.

According to the embodiment of the device 2 shown in FIG. 2, the limiter 24 may be displaceable arranged in an upper part of the slit nozzle 12. Moreover, the limiter 24 may be arranged at a nose section of the slit nozzle 12.

Figure 9:
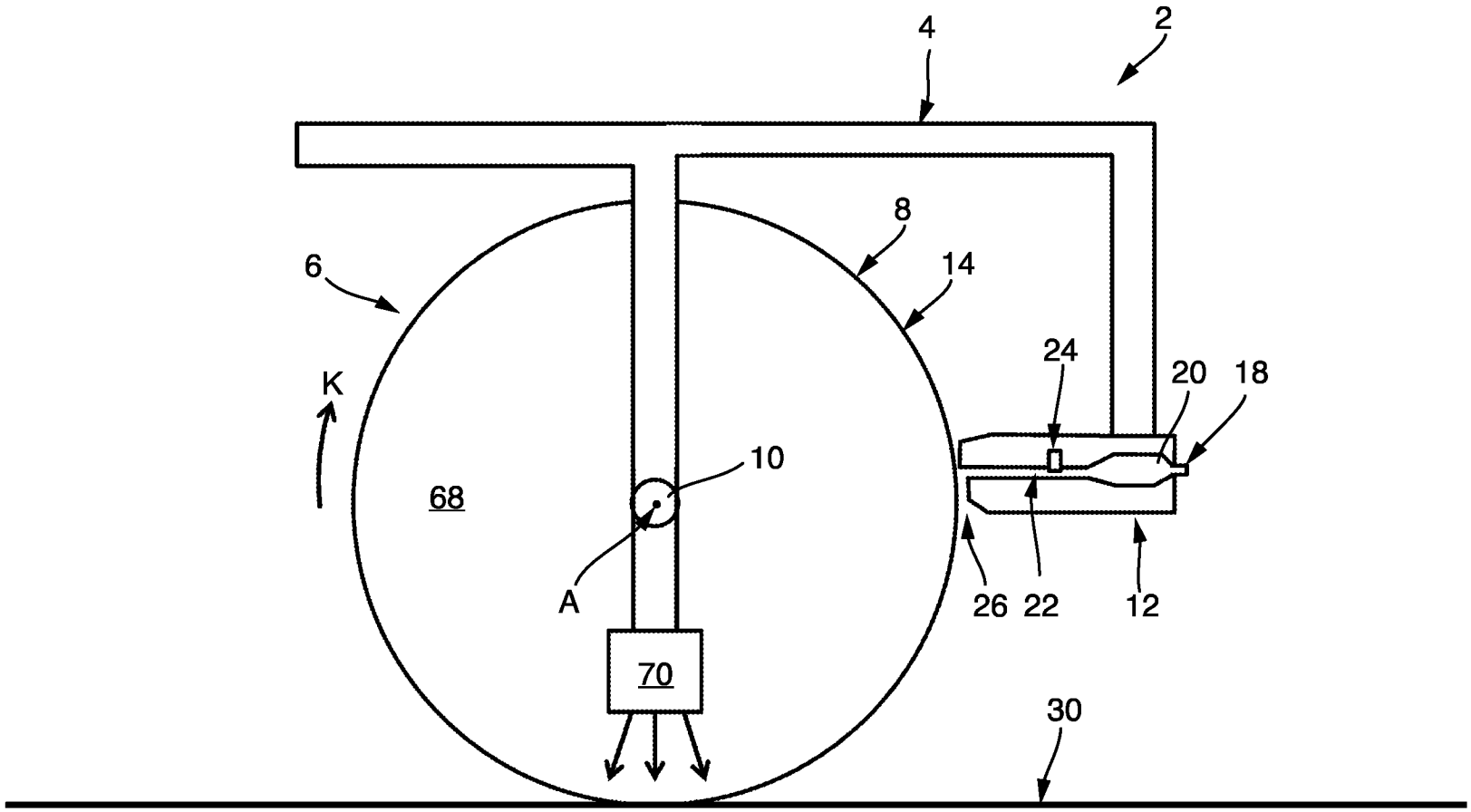
FIG. 9 schematically illustrates another embodiment of the device in a cross-sectional view.

According to another embodiment of the device 2, which is schematically shown in FIG. 9, the limiter 24 may be arranged between the muzzle end 26 and the nozzle-cavity 20, such that the limiter 24 can adjust the cross-section 28 in a restriction area of the nozzle-channel 22.

Figure 10:
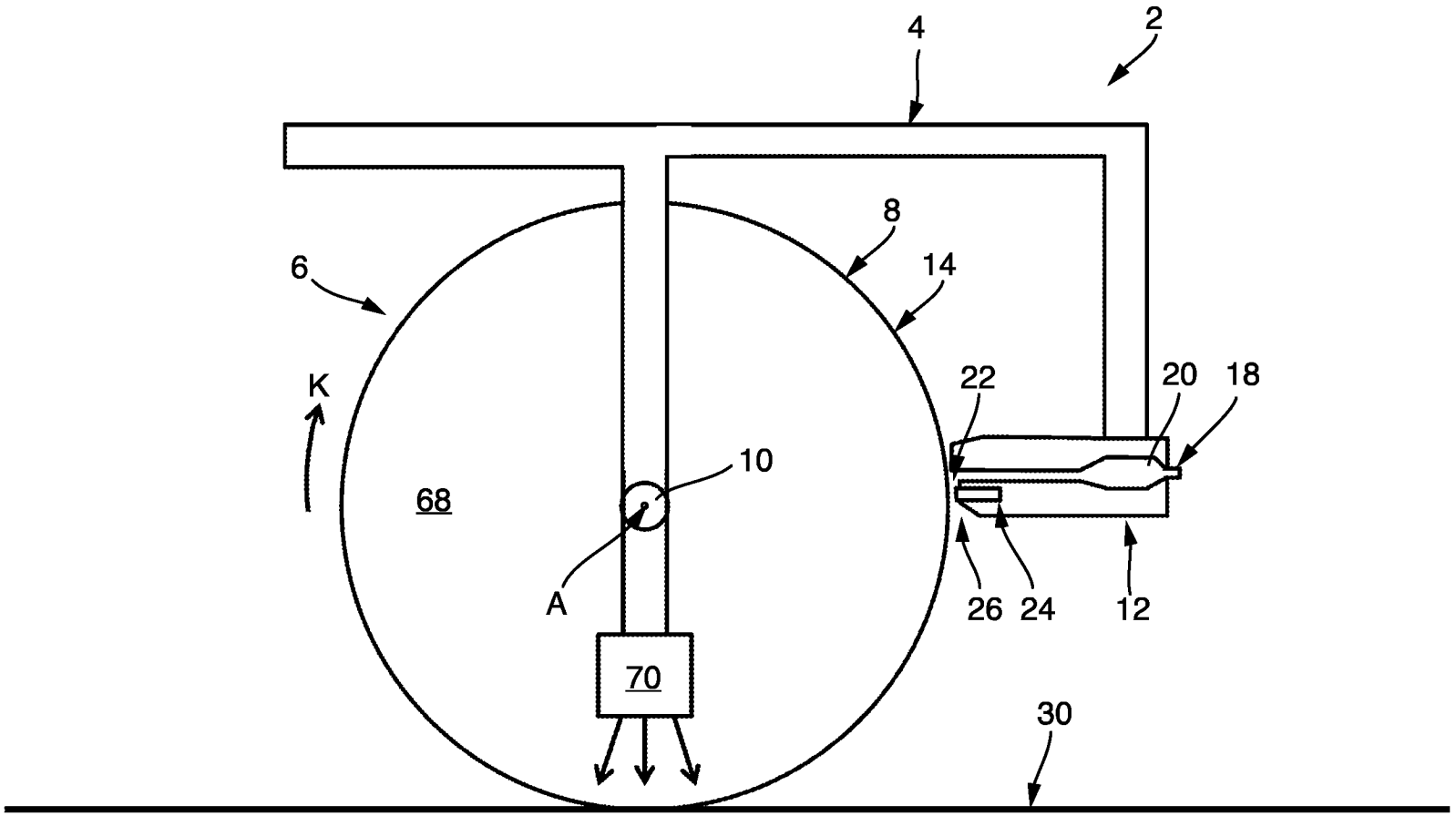
FIG. 10 schematically illustrates another embodiment of the device in a cross-sectional view.

Another embodiment of the device 2 is schematically shown in FIG. 10. According to this embodiment, the limiter 24 is displaceable arranged in a lower part of the slit nozzle 12, such that the limiter 24 can be displaced towards or away from the lateral wall 8 of the transfer roller 6. As a result, the effective cross-section, such as cross-section 28 in FIG. 5, of the nozzle-channel 22 between the nozzle-cavity 20 in the muzzle end 26 can be adjusted.

According to a preferred embodiment, the device 2 may comprise a hardening unit 70. The hardening unit 70 is configured for hardening the lacquer, preferably contactless. The hardening unit 70 can be formed by an UV-light unit. The hardening unit 70 is directly or indirectly connected to the frame 4. Moreover, the hardening unit 70 can be arranged within the interior space 68 formed by the transfer roller 6. For instance, if the hardening unit 70 is formed by an UV-light unit, the lateral wall 8 of the transfer roller 6 may be configured to transmit UV-light-waves. Thus, the lateral wall 8 can be transparent for UV-light. The hardening unit 70 can be arranged, such that UV-light is emitted towards a work surface 30 upon which the lateral wall 8 of the transfer roller 6 can roll. The lacquer may be hardenable via UV-light. Therefore, the device 2 may be configured to control the drive unit 10 and/or the UV-light unit, such that lacquer transferred to the work surface 30 is immediately hardened via UV-light emitted by the UV-light unit.

Figure 14:
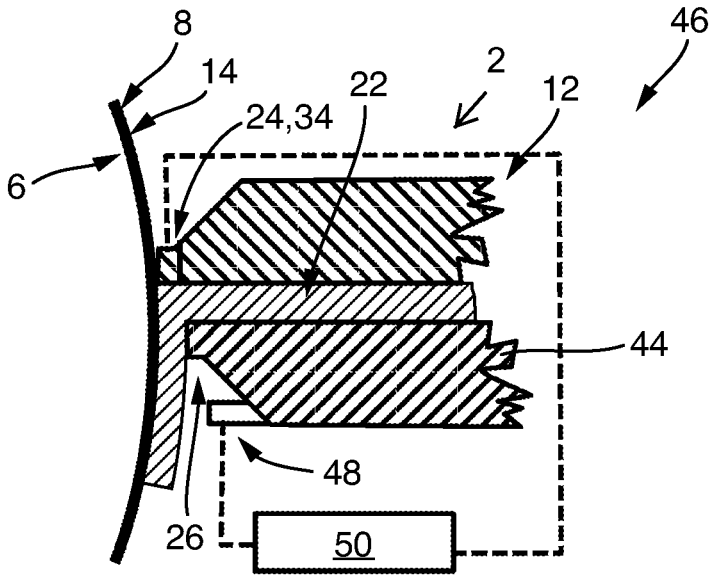
FIG. 14 schematically illustrates an embodiment of the system.

An embodiment of the system 46 according to the disclosure herein is schematically illustrated in FIG. 14. The system 46 comprises a device 2. Furthermore, the system 46 comprises a sensor 48, which is configured to detecting thickness of the lacquer. The system 46 also comprises a control unit 50. The sensor 48 is connected, preferably via a signal line, to the control unit 50 to transmit a sensor signal to the control unit 50, wherein the sensor signal represents a detected thickness of the lacquer. According to a preferred embodiment, the sensor 48 may be arranged, such that the sensor 48 can detect the thickness of the lacquer on the outside contact surface 14 of the lateral wall 8 of a transfer roller 6. For instance, the sensor 48 can be mounted to the slit nozzle 12, such that the thickness of the dispensed lacquer on the outside contact surface 14 can directly be detected. The sensor 48 may be configured to detect the thickness contactless.

The control unit 50 is configured to control the actuator unit 34 of the device 2 based on the detected thickness of the lacquer. For instance, the control unit 50 may have access to a reference value, which represents a reference thickness for the lacquer to be dispensed on the outside contact surface 14 of the lateral wall 8. The detected thickness of the lacquer on the outside contact surface 14 is also provided to the control unit 50. The control unit 50 may be configured to compare the reference thickness with the detected thickness and based on the result of the comparison in particular depending on the respective error, the control unit 50 may control the actuator unit 34, such that its actuators 36 displaced the associated limiter 24 in order to reach a thickness for the lacquer D on the outside contact surface 14, which corresponds to the reference thickness. According to a preferred embodiment, the control unit 50 may be configured to control each of the actuators 36 of the actuator unit 34 individually.

According to a further embodiment, the sensor 48 may be arranged differently, such that the sensor 48 is arranged to detect the thickness of the lacquer transferred to the work surface 30 of the work piece 32. But in general, the previous explanations apply in an analogous manner.

It is additionally pointed out that "comprising" does not rule out other elements, and "a" or "an" does not rule out a multiplicity. It is also pointed out that features that have been described with reference to one of the above exemplary embodiments may also be disclosed as in combination with other features of other exemplary embodiments described above. Reference signs in the claims are not to be regarded as restrictive.

While at least one example embodiment of the invention (s) is disclosed herein, it should be understood that modifications, substitutions and alternatives may be apparent to one of ordinary skill in the art and can be made without departing from the scope of this disclosure. This disclosure is intended to cover any adaptations or variations of the example embodiment(s). In addition, in this disclosure, the terms "comprise" or "comprising" do not exclude other elements or steps, the terms "a", "an" or "one" do not exclude a plural number, and the term "or" means either or both. Furthermore, characteristics or steps which have been described may also be used in combination with other characteristics or steps and in any order unless the disclosure or context suggests otherwise. This disclosure hereby incorporates by reference the complete disclosure of any patent or application from which it claims benefit or priority.

The invention claimed is:

1. A device for a lacquer transfer, the device comprising:

a frame;

a transfer roller mounted rotatably about an axis of rotation at the frame and comprising a circumferential lateral wall which has an outside contact surface that comprises several depressions;

a drive unit mounted to the frame and configured to drive the transfer roller such that the transfer roller rotates about the axis of rotation;

a slit nozzle at least indirectly connected to the frame and comprising a supply connection, a nozzle-cavity, a slit-shaped nozzle-channel, and at least one limiter;

wherein the supply connection is coupled to the nozzle-cavity for supplying lacquer to the nozzle-cavity;

wherein the nozzle-channel extends from the nozzle-cavity to a muzzle end, which is formed by the slit nozzle at an end of the nozzle-channel and configured for dispensing lacquer;

wherein the slit nozzle is configured, by the at least one limiter, to adjust a cross-section in a restriction area of the nozzle-channel;

wherein the muzzle end of the slit nozzle is arranged contactless or in direct contact with the outside contact surface for dispensing lacquer into respective depressions; and wherein the transfer roller is configured to roll with the outside contact surface on a work surface of a work piece for transferring the lacquer from the depressions to the work surface of the work piece.

2. The device of claim 1, wherein the at least one limiter is at the muzzle end of the nozzle-channel.

3. The device of claim 1, wherein the at least one limiter is configured such that, when displaced, the cross-section in the restriction area of the nozzle-channel is reduced.

4. The device of claim 3, wherein the at least one limiter is between the muzzle end of the nozzle-channel and the nozzle-cavity.

5. The device of claim 3, wherein the device comprises an actuator unit, which is at least indirectly connected to the at least one limiter and is configured to displace the at least one limiter.

6. The device of claim 3, wherein the at least one limiter of the slit nozzle is a plurality of limiters.

7. The device of claim 6, wherein the device comprises an actuator unit, which is at least indirectly connected to the plurality of limiters and is configured to displace the plurality of limiters, and wherein the plurality of limiters are in alignment one behind another in a direction of a width of the nozzle-channel.

8. The device of claim 7, wherein the actuator unit comprises, for each of the plurality of limiters, an associated actuator, which is configured to individually displace an associated limiter of the plurality of limiters.

9. The device of claim 6, wherein the plurality of limiters are formed by rods, flaps, lever arms, membranes, inflatable bellows, or inflatable tubes.

10. The device of claim 3, wherein the slit nozzle comprises exactly one limiter, which is formed by a nozzle-part of the slit nozzle, and wherein the nozzle-channel is at least partly formed by the nozzle-part.

11. A system for a lacquer transfer, comprising:

a device for a lacquer transfer, the device comprising:

a frame;

a transfer roller mounted rotatably about an axis of rotation at the frame and comprising a circumferential lateral wall which has an outside contact surface that comprises several depressions;

a drive unit mounted to the frame and configured to drive the transfer roller such that the transfer roller rotates about the axis of rotation;

a slit nozzle at least indirectly connected to the frame and comprising a supply connection, a nozzle-cavity, a slit-shaped nozzle-channel, and at least one limiter; and an actuator unit configured to displace the at least one limiter;

wherein the supply connection is coupled to the nozzle-cavity for supplying lacquer to the nozzle-cavity;

wherein the nozzle-channel extends from the nozzle-cavity to a muzzle end, which is formed by the slit nozzle at an end of the nozzle-channel and configured for dispensing lacquer;

wherein the slit nozzle is configured, by the at least one limiter, to adjust a cross-section in a restriction area of the nozzle-channel;

wherein the muzzle end of the slit nozzle is arranged contactless or in direct contact with the outside contact surface for dispensing lacquer into respective depressions; and wherein the transfer roller is configured to roll with the outside contact surface on a work surface of a work piece for transferring the lacquer from the depressions to the work surface of the work piece;

a sensor configured to detect a thickness of the lacquer; and a control unit;

wherein the sensor is connected to the control unit to transmit a sensor signal to the control unit, which sensor signal represents detected thickness of the lacquer;

wherein the control unit is connected to the actuator unit of the device, such that the actuator unit is controllable via the control; and wherein the control unit is configured to control the actuator unit of the device based on the detected thickness of the lacquer.

12. The system of claim 11, wherein the sensor is arranged to detect thickness of the lacquer on the outside contact surface of the lateral wall of the transfer roller.

13. The system of claim 11, wherein the sensor is arranged to detect thickness of the lacquer transferred to the work surface of the work piece.

14. The system of claim 11 wherein the at least one limiter is configured to be displaced to reduce the cross-section in the restriction area of the nozzle-channel, wherein the actuator unit is at least indirectly connected to the at least one limiter, and wherein the control unit is configured to control each actuator of the actuator unit individually.

15. The system of claim 14, wherein the at least one limiter is a plurality of limiters that are in alignment one behind another in a direction of a width of the nozzle-channel.

16. The device of claim 1, comprising a hardening unit for hardening the lacquer.

17. The device of claim 16, wherein the hardening unit is arranged within an interior space formed by the transfer roller.

18. The device of claim 17, wherein the hardening unit comprises a UV-light unit and is configured to harden the lacquer in a contactless manner.

19. The device of claim 18, wherein the lateral wall of the transfer roller is transparent for UV light emitted by the hardening unit.

20. The device of claim 19, wherein the UV-light unit is positioned within the interior space of the transfer roller so that lacquer transferred to the work surface can be immediately hardened via the UV light emitted by the UV-light unit.

* * * * *